US009624699B2

(12) United States Patent
Rocchitelli

(10) Patent No.: US 9,624,699 B2
(45) Date of Patent: Apr. 18, 2017

(54) PUSH-PULL CLOSING DEVICE

(75) Inventors: Onofrio Rocchitelli, Nerviano (IT); Stefano Rocchitelli, legal representative, Nerviano (IT)

(73) Assignee: ELETTROTECNICA ROLD S.R.L., Nerviano (Milan) (IT)

( * ) Notice: Subject to any disclaimer, the term of this patent is extended or adjusted under 35 U.S.C. 154(b) by 0 days.

(21) Appl. No.: 13/642,277

(22) PCT Filed: Apr. 18, 2011

(86) PCT No.: PCT/IT2011/000120

§ 371 (c)(1),
(2), (4) Date: Feb. 1, 2013

(87) PCT Pub. No.: WO2011/132213

PCT Pub. Date: Oct. 27, 2011

(65) Prior Publication Data

US 2013/0127181 A1 May 23, 2013

(30) Foreign Application Priority Data

Apr. 21, 2010 (IT) ..... MI2010A0676

(51) Int. Cl.

| | |
|---|---|
| ***E05C 1/06*** | (2006.01) |
| ***E05C 1/08*** | (2006.01) |
| ***D06F 37/28*** | (2006.01) |
| ***D06F 39/14*** | (2006.01) |
| ***E05C 3/24*** | (2006.01) |
| ***E05C 19/02*** | (2006.01) |
| *E05C 3/06* | (2006.01) |
| *E05C 3/04* | (2006.01) |

(Continued)

(52) U.S. Cl.

CPC ..... *E05C 1/08* (2013.01); *D06F 37/28* (2013.01); *D06F 39/14* (2013.01); *E05C 3/24* (2013.01); *E05C 19/024* (2013.01); *E05B 63/0069* (2013.01); *Y10T 292/1005* (2015.04)

(58) Field of Classification Search

CPC .. E05C 5/00; E05B 17/2057; Y10T 24/45749; Y10T 403/60; D06F 37/28; D06F 39/14

USPC ..... 292/182, DIG. 69, 198, 201, 216, 194, 292/219, 228, 202, 203, 207, 302, 57, 230

See application file for complete search history.

(56) References Cited

U.S. PATENT DOCUMENTS 192,896 A * 7/1877 Brown ..... 292/198
512,593 A * 1/1894 Webster et al. ..... 292/213

(Continued)

FOREIGN PATENT DOCUMENTS

| | | |
|---|---|---|
| EP | 2 087 829 | 8/2009 |
| FR | 2 213 462 | 8/1974 |

*Primary Examiner* — Kristina Fulton
*Assistant Examiner* — Faria Ahmad
(74) *Attorney, Agent, or Firm* — Jacobson Holman, PLLC.

(57) ABSTRACT

The invention regards a locking device for the closing door of a washing and drying machine, constituted of a body of containment that houses a locking wheel for the door latch, subject to the action of elastic means, a sliding bolt capable of preventing the rotation of said wheel and a time-delay mechanism fitted with a locking pawl for said sliding bolt. The wheel is fitted with a cavity that presents a surface tilted with respect to the plane of rotation, so as to resolve the force it exerts on the bolt, when a pulling is exerted on the door while the device is in a closed and locked position.

4 Claims, 1 Drawing Sheet

Figure 1:
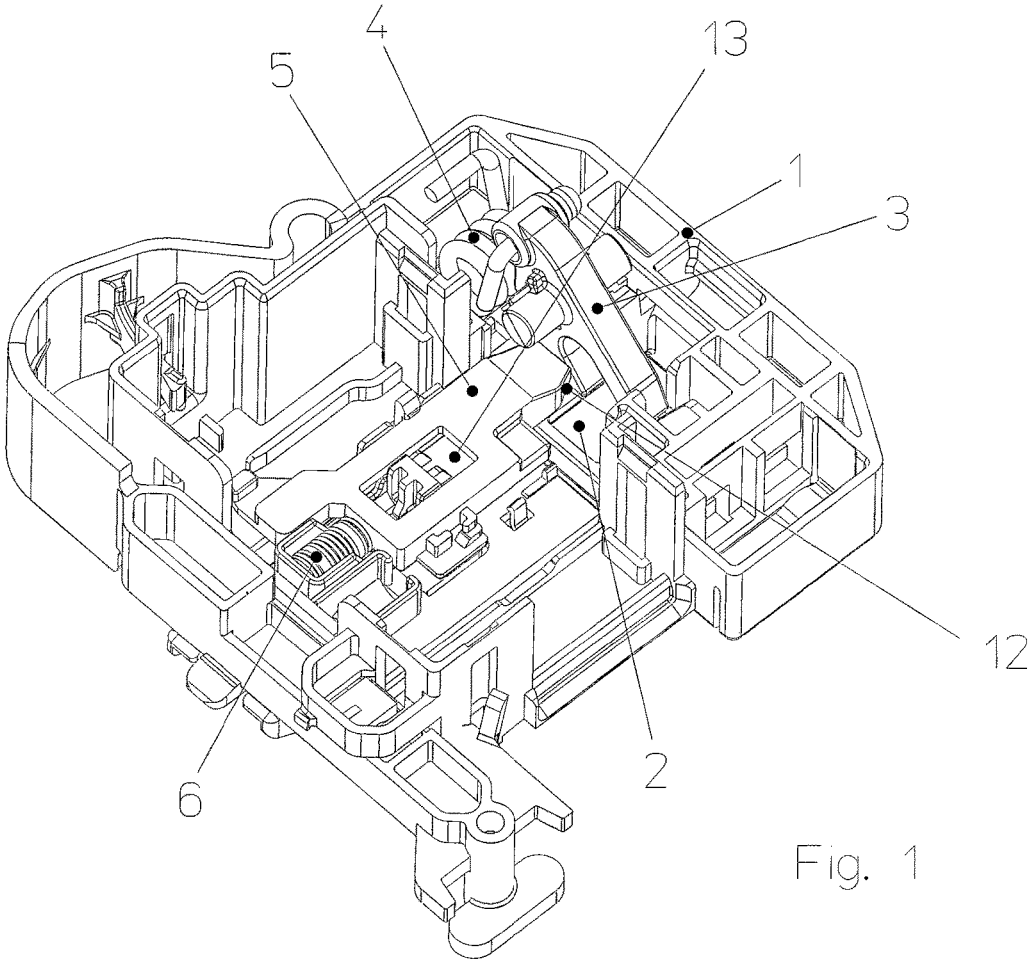

(51) Int. Cl.
*E05C 3/16* (2006.01)
*E05B 63/00* (2006.01)

(56) References Cited

U.S. PATENT DOCUMENTS 1,158,533 A * 11/1915 Moore ..... 292/71
1,664,576 A * 4/1928 Stuart et al. ..... 292/127
1,711,213 A * 4/1929 Smith ..... 292/198
1,937,978 A * 12/1933 Dorr ..... 292/127
2,138,251 A * 11/1938 Lindstrom et al. ..... 292/198
2,910,859 A * 11/1959 Allen et al. ..... 70/135
3,667,793 A * 6/1972 Varrin et al. ..... 292/216
3,851,905 A * 12/1974 Klebba ..... 292/11
3,936,086 A * 2/1976 Berkowitz ..... 292/341.17
4,208,837 A * 6/1980 Black et al. ..... 49/56
4,351,288 A * 9/1982 Gasloli ..... 126/197
4,480,863 A * 11/1984 Hormann ..... 292/216
4,489,807 A * 12/1984 Rodriquez ..... 182/96
4,765,662 A * 8/1988 Suska ..... 292/92
4,907,831 A * 3/1990 Di Giusto ..... 292/216
4,938,508 A * 7/1990 Thomas ..... 292/235
4,993,759 A * 2/1991 Thomas ..... 292/235
5,063,764 A * 11/1991 Amis et al. ..... 70/100
5,176,417 A * 1/1993 Bauer ..... 292/201
5,193,861 A * 3/1993 Juga et al. ..... 292/49
5,518,040 A * 5/1996 Rupflin ..... 139/57
5,520,424 A * 5/1996 Hapke et al. ..... 292/198
5,691,520 A * 11/1997 Hapke et al. ..... 200/61.62
5,713,691 A * 2/1998 Solberg ..... 403/322.2
5,735,557 A * 4/1998 Harvey ..... 292/216
5,823,017 A * 10/1998 Hapke et al. ..... 68/12.26
6,010,168 A * 1/2000 Johnson ..... 292/341.17
6,036,241 A 3/2000 Ostdiek
6,048,001 A * 4/2000 Miller et al. ..... 292/198
6,079,756 A * 6/2000 Phillips ..... 292/198
6,102,453 A * 8/2000 Cetnar ..... 292/201
6,106,032 A * 8/2000 Och ..... 292/207
6,155,616 A * 12/2000 Akright ..... 292/207
6,363,755 B1 * 4/2002 Hapke et al. ..... 68/12.26
6,364,376 B1 * 4/2002 Spargo ..... 292/97
6,390,518 B1 * 5/2002 Elick ..... 292/216
6,402,208 B1 * 6/2002 Shimizu ..... 292/123
6,474,702 B1 * 11/2002 Malone et al. ..... 292/97
6,527,315 B2 * 3/2003 Marks et al. ..... 292/341.15
6,565,164 B2 * 5/2003 Irwin et al. ..... 312/228
6,601,882 B1 * 8/2003 Cole ..... 292/110
6,685,241 B2 * 2/2004 Bollmann ..... 292/341.16
6,709,029 B2 * 3/2004 Cole ..... 292/110
6,786,519 B2 * 9/2004 Gartner ..... 292/195
6,840,553 B2 * 1/2005 Dirnberger et al. ..... 292/341.16
6,913,296 B2 * 7/2005 Bassi ..... 292/122
7,032,939 B2 * 4/2006 Magnusson ..... 292/333
7,334,823 B2 * 2/2008 Courter et al. ..... 292/201
7,364,209 B2 * 4/2008 Lomicka et al. ..... 292/95
7,461,872 B2 * 12/2008 Moon et al. ..... 292/209
7,617,703 B2 * 11/2009 Osvatic ..... D06F 37/28 68/12.26
7,770,944 B2 * 8/2010 Yuan ..... 292/195
8,152,207 B2 * 4/2012 Hartmann et al. ..... 292/95
8,226,129 B2 * 7/2012 Okunaka et al. ..... 292/11
8,261,586 B2 * 9/2012 Gartner ..... 70/277
8,276,951 B2 * 10/2012 Dirnberger et al. ..... 292/336
8,342,581 B2 * 1/2013 Dow ..... 292/216
8,376,418 B2 * 2/2013 Osvatic et al. ..... 292/216
8,646,816 B2 * 2/2014 Dziurdzia et al. ..... 292/201
8,651,535 B2 * 2/2014 Oppel et al. ..... 292/198
8,814,094 B2 * 8/2014 Tran ..... 244/129.4
8,826,709 B2 * 9/2014 Dehaven et al. ..... 70/416
8,894,107 B2 * 11/2014 Kamata et al. ..... 292/216
2002/0056997 A1 * 5/2002 Bassi ..... 292/226
2002/0073752 A1 * 6/2002 Dirnberger et al. ..... 70/266
2003/0034655 A1 * 2/2003 Mejean et al. ..... 292/201
2003/0080569 A1 * 5/2003 Raymond et al. ..... 292/201
2003/0116975 A1 * 6/2003 Cole ..... 292/110
2003/0127865 A1 * 7/2003 Gartner ..... 292/195
2003/0160461 A1 * 8/2003 Promutico ..... 292/216
2003/0197387 A1 * 10/2003 Dirnberger ..... 292/216
2004/0104580 A1 * 6/2004 Spiessl et al. ..... 292/84
2005/0194795 A1 * 9/2005 Hapke et al. ..... 292/216
2005/0206172 A1 * 9/2005 Bacon ..... 292/216
2006/0001275 A1 * 1/2006 Plett et al. ..... 292/216
2006/0033346 A1 * 2/2006 Ala ..... 292/216
2006/0101869 A1 5/2006 Osvatic
2006/0131893 A1 * 6/2006 Tomaszewski ..... 292/216
2007/0158955 A1 * 7/2007 Homner ..... 292/202
2007/0252394 A1 * 11/2007 Moon et al. ..... 292/201
2008/0042447 A1 * 2/2008 Neumann ..... 292/126
2008/0073916 A1 * 3/2008 Min ..... 292/201
2008/0296916 A1 * 12/2008 Kintz ..... 292/257
2009/0235767 A1 * 9/2009 Garneau et al. ..... 74/56
2009/0295174 A1 * 12/2009 Corrales et al. ..... 292/169.14
2010/0005621 A1 * 1/2010 Tomioka et al. ..... 16/82
2010/0052338 A1 * 3/2010 Osvatic et al. ..... 292/216
2010/0270816 A1 * 10/2010 Yuan ..... 292/201
2011/0101707 A1 * 5/2011 Perkins et al. ..... 292/199
2012/0119522 A1 * 5/2012 Bauriedl ..... 292/228
2012/0126552 A1 * 5/2012 Ala ..... 292/228
2013/0127181 A1 * 5/2013 Rocchitelli ..... 292/182
2013/0269403 A1 * 10/2013 Kowalczyk ..... E05B 47/0001 70/278.7

* cited by examiner

PUSH-PULL CLOSING DEVICE

This is a national stage of PCT/IT11/000120 filed Apr. 18, 2011 and published in English, which has a priority of Italian no. MI2010A000676 filed Apr. 21, 2010, hereby incorporated by reference.

The present invention regards a device for the closing of the door of domestic appliances, in particular of washing machines. The invention will in the following be described with reference to such a type of appliance, without this being intended in a limited sense.

The door closing the washing machine's charging space is fitted with a latch capable of engaging a locking device mounted on the panel of the machine.

The locking devices of the machines equipped with drums of a particular size, such as in drying machines, must, for safety reasons, allow the opening of the door even from the inside of the machine, by simply exerting a pressure of a pre-established intensity.

In order to observe the safety rules, the locking devices employed in this domain moreover comprise a time-delaying device of an electromagnetic or thermal type, commonly known as a door lock, which prevents the opening of the door after the startup of the machine and delays the opening of the door at the end of the operating cycle or at the occurrence of certain conditions. Locking devices of a "push-pull" type are known, which allow effecting the closing of the door by simply exerting a pressing action, and its opening by applying a relatively modest pulling force. Such devices are thus allowing the opening of the door to be realized even from inside the machine.

A known locking device of this type is constituted of an oscillating wheel capable of constraining the extremity of the door's closing latch, and of a sliding bolt translating in a direction perpendicular to the plane of rotation of the wheel.

The wheel assumes a releasing position and a retaining position of the latch based on the action of elastic means of a compressing type, while the sliding bolts prevents a rotation until certain conditions occur.

A drawback of some already known devices derives from the fact that they are not always capable of realizing a proper sealing of the door. If a pulling force of particular intensity were to be exercised on the door, its opening could in fact occur even during the machine's operation, thus under conditions when the sliding bolt, being constrained by the pawl of the door locking device, should guarantee its closing.

The known devices that allow guaranteeing a proper seal in a locking phase have the drawback of being constructed with certain kinematic devices of considerable size or made of expensive materials.

The purpose of the present invention is to overcome the drawbacks and limitations of the previous art, by a new and improved kinematic device that allows reducing the size of the closing device so that the same can be easily applied even to washing machines already present on the market, without requiring structural modifications, and a production with materials similar to those currently employed.

The innovation achieves these purposes through a locking device for the door of washing machines or the like, of a push-pull type according to claim 1. Additional advantageous characteristics are the object of subordinate claims.

Figure 2:
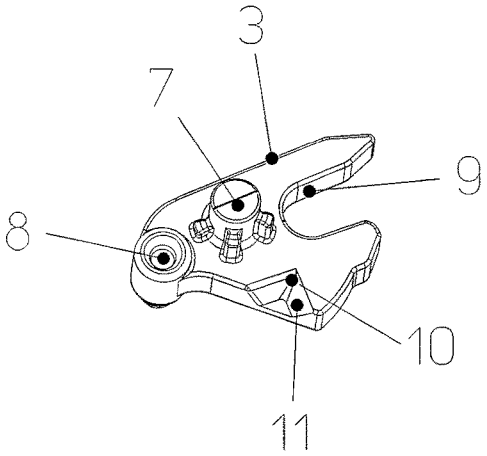

The invention will now be described with reference to the enclosed drawings, which illustrate a preferred yet not limiting form of embodiment of the invention, where:

FIG. 1 is an axonometric view of the closing device according to the invention, FIG. 2 shows the locking wheel of the device of FIG. 1.

With reference to the figures, the closing device according to the invention is constituted of a containment body 1, preferably made of a thermoplastic material and equipped with means fastening it to the panel of the machine. A rectangular opening 2 is carved out in the body 1 and fitted, in a known manner, with a projecting frame not evidenced in the figure. When the device is installed, the opening 2 is disposed opposite to the inlet hole of the door latch, provided on the panel of the machine, and the projecting frame serves the function of inviting the latch as well as an esthetic finish.

The body 1 houses a locking wheel 3 subject to the action of a torsion spring 4 and a sliding bolt 5 subject to the action of a helical spring 6.

An electromagnetic or thermal time-delay mechanism of a known type (not evidenced in the figure) is housed in the body 1 opposite the bolt 5, and equipped with a locking pawl that is actuated by a system connected to the machine's operating controls. At a point opposite to the time-delay mechanism, the bolt 5 presents a seat 13 capable of receiving the locking pawl.

The wheel 3 is constrained in a hinge-like manner to the body 1, through a pin 7. It has a cavity 9 suitable for receiving the extremity of the door latch and is, in a diametrically opposite position, fitted with a seat 8 designed to house the extremities of the torsion spring 4.

The locking wheel 3 may, under the action exerted by the spring 4, assume two positions of a stable equilibrium, meaning a resting position as shown in FIG. 1, where the cavity 9 is axially disposed with respect to the opening 2, and a position of retaining the door latch, in which the wheel closes the opening 2, thus preventing an extraction of the latch.

The wheel 3 has, at a point opposite to the portion interacting with the sliding bolt 5, a cavity 10 shaped so as to present a flat surface 11 tilted with respect to the plane of rotation.

The contoured extremity of the sliding bolt 5, which cooperates with the wheel 3, presents a flat face orthogonal to the direction of translation, and a face 12 oblique with respect to said direction and appropriately tilted to interact with the surface 11 of the wheel 3.

The slant of the surface 11 is determined so as to resolve the force that is exerted by the wheel 3 on the sliding bolt 5 while pulling the door, into two components. The first component is applied to the bolt 5 in a direction oblique with respect to the direction of translation and opposed by the constraining reaction exerted by the body 1; the second component, of a lesser value than the first, works in the direction of translating the bolt, and is opposed by the locking pawl of the time-delay mechanism.

The operation of the device occurs in the following manner.

When the door is in an open position, the mechanical components are in their respective positions shown in FIG. 1.

In particular, the wheel 3 in a resting position prevents a translation of the cursor 5, which in turn inhibits the action of the door locking pawl and the consequent startup of the machine.

When the door is closed, the latch is inserted into the opening 2 and acts on the locking wheel 3, thus inducing its rotation.

At the same time, the cursor 5 translates and the contoured extremity taps into the cavity 10, thus establishing the contact between the surfaces 12 and 11.

When the door is closed yet still unlocked, meaning before actuating the door locking pawl, the wheel 3 can be driven to rotate against the elastic means 4, thus causing the sliding bolt 5 to withdraw and the door to open even from the inside of the machine, while exerting a pressing action on the door.

When operating the machine, the pawl of the door locking device taps into the seat 13 in a position locking the cursor 5 and thereby the wheel 3. Even if applying a pulling action on the door, it is under these conditions impossible to cause an opening, because the rotation of the locking wheel 3 is inhibited by the cursor 5, which is in turn constrained by the pawl of the door locking device.

Even in case a pulling force of particular intensity is exerted on the door, the device is capable of preventing its opening, because the force exerted by the wheel 3 on the cursor 5 is resolved into two components and need therefore not be opposed by the locking pawl alone. A prime component is in fact, through the surface 11, acting on the sliding bolt 5, which is in turn constrained by the body 1 in a transversal direction, and a lesser component acts in the translating direction of the bolt 5 and can be properly opposed by the locking pawl of the time-delay mechanism.

At the end of the operating cycle, the locking pawl withdraws in a known manner while releasing the cursor 5, thus allowing the rotation of the wheel 3 and the extraction of the latch from the door. The elements of the device return to their respective positions as shown in FIG. 1.

The invention has been illustrated with reference to a preferred construction, but it is generally susceptible of other applications and modifications, all meant to be comprised in the range of protection, as will be evident to a specialist in the branch.

The invention claimed is:

1. A locking device for the door of household appliances, comprising a body of containment that houses a door latch locking wheel subject to the action of elastic means, a sliding bolt capable of preventing the rotation of said wheel and adapted to be operably connected with a time-delay mechanism to actuate a locking pawl of the time-delay mechanism for said sliding bolt, wherein the wheel is fitted with a cavity that presents a surface tilted with respect to the plane of rotation, so as to interact with the contoured extremity of the sliding bolt, which is likewise tilted so as to resolve the force exerted by the wheel on the sliding bolt while pulling the door into two components, a first component of the force working in the direction oblique with respect to the direction of translating the sliding bolt and opposing by the constraining reaction exerted by the body of containment, a second component of the force working in the direction of translating the sliding bolt and opposing by the locking pawl of the time-delayed mechanism, therefore preventing the opening of the door when the door is closed and the locking pawl is actuated; wherein the sliding direction of the sliding bolt is orthogonal to the plane of rotation of the locking wheel; wherein the cavity is on the surface of the wheel which is parallel to the rotational plane of the wheel, and the tilted surface is tilted with respect to a back surface of the cavity.

2. The locking device according to claim 1, characterized by the fact that the wheel is hinge-tied to the body through a pin.

3. The locking device according to claim 1, characterized by the fact that the wheel is subject to the action of a torsion spring.

4. The locking device according to claim 1, characterized by the fact that the extremity of the sliding bolt interacting with the wheel is contoured so as to present a flat face orthogonal to the direction of sliding.

* * * * *